US010221052B1

(12) United States Patent
Anderson

(10) Patent No.: US 10,221,052 B1
(45) Date of Patent: Mar. 5, 2019

(54) HAND CHAIN LIFT MOTOR CONVERSION DEVICE

(71) Applicant: Cordell Anderson, Ashland, WI (US)

(72) Inventor: Cordell Anderson, Ashland, WI (US)

( * ) Notice: Subject to any disclaimer, the term of this patent is extended or adjusted under 35 U.S.C. 154(b) by 0 days.

(21) Appl. No.: 15/696,493

(22) Filed: Sep. 6, 2017

(51) Int. Cl.
*B66D 3/20* (2006.01)

(52) U.S. Cl.
CPC ..... *B66D 3/20* (2013.01)

(58) Field of Classification Search
CPC ..... B66D 3/12; B66D 3/16; B66D 3/20
See application file for complete search history.

(56) References Cited

U.S. PATENT DOCUMENTS

| | | | | |
|---|---|---|---|---|
| 1,576,986 | A * | 3/1926 | Mullen | B66D 3/12 254/358 |
| 3,226,089 | A * | 12/1965 | Patz | B66D 3/12 254/358 |
| 3,244,293 | A | 4/1966 | Stahmer | |
| 5,386,970 | A * | 2/1995 | Trant | B25F 5/00 254/344 |
| 6,179,270 | B1 * | 1/2001 | Higdon | B66D 3/16 254/358 |
| 6,435,768 | B1 | 8/2002 | Mansfield | |
| 6,554,255 | B2 * | 4/2003 | Fujikawa | B66D 3/14 254/342 |
| 7,021,427 | B2 | 4/2006 | Skovgaard et al. | |
| 7,350,247 | B2 | 4/2008 | Bogh-Sorensen | |
| 7,784,768 | B2 | 8/2010 | LaFreniere | |
| 8,006,958 | B2 | 8/2011 | Starks et al. | |
| 8,944,413 | B1 | 2/2015 | Hatch et al. | |
| 9,315,365 | B2 * | 4/2016 | Sargent | B66D 3/16 |
| 9,403,664 | B2 | 8/2016 | Ogawa et al. | |
| 9,573,665 | B2 | 2/2017 | Ogden | |
| 2013/0305954 | A1 * | 11/2013 | Ogden | B61B 11/002 104/173.2 |
| 2015/0123056 | A1 * | 5/2015 | Hawkins | B66D 1/08 254/339 |

FOREIGN PATENT DOCUMENTS

| | | |
|---|---|---|
| WO | WO2005070811 | 8/2005 |

* cited by examiner

*Primary Examiner* — Sang K Kim
*Assistant Examiner* — Nathaniel L Adams

(57) ABSTRACT

A manual to motorized chain lift conversion system converts a manually operated chain lift into a motor operated chain lift. The system includes a chain lift having a drive shaft which is exposed when a chain wheel is removed from the chain lift. An adapter is coupled to the lift frame. A motor is coupled to the adapter such that the motor engages and rotates the drive shaft of the chain lift. A battery is coupled to the adapter and electrically coupled to the motor wherein the motor is powered by the battery.

15 Claims, 3 Drawing Sheets

HAND CHAIN LIFT MOTOR CONVERSION DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to conversion devices and more particularly pertains to a new conversion device for converting a manually operated chain lift into a motor operated chain lift.

BRIEF SUMMARY OF THE INVENTION

An embodiment of the disclosure meets the needs presented above by generally comprising a chain lift having a drive shaft which is exposed when a chain wheel is removed from the chain lift. An adapter is coupled to the lift frame. A motor is coupled to the adapter such that the motor engages and rotates the drive shaft of the chain lift. A battery is coupled to the adapter and electrically coupled to the motor wherein the motor is powered by the battery.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
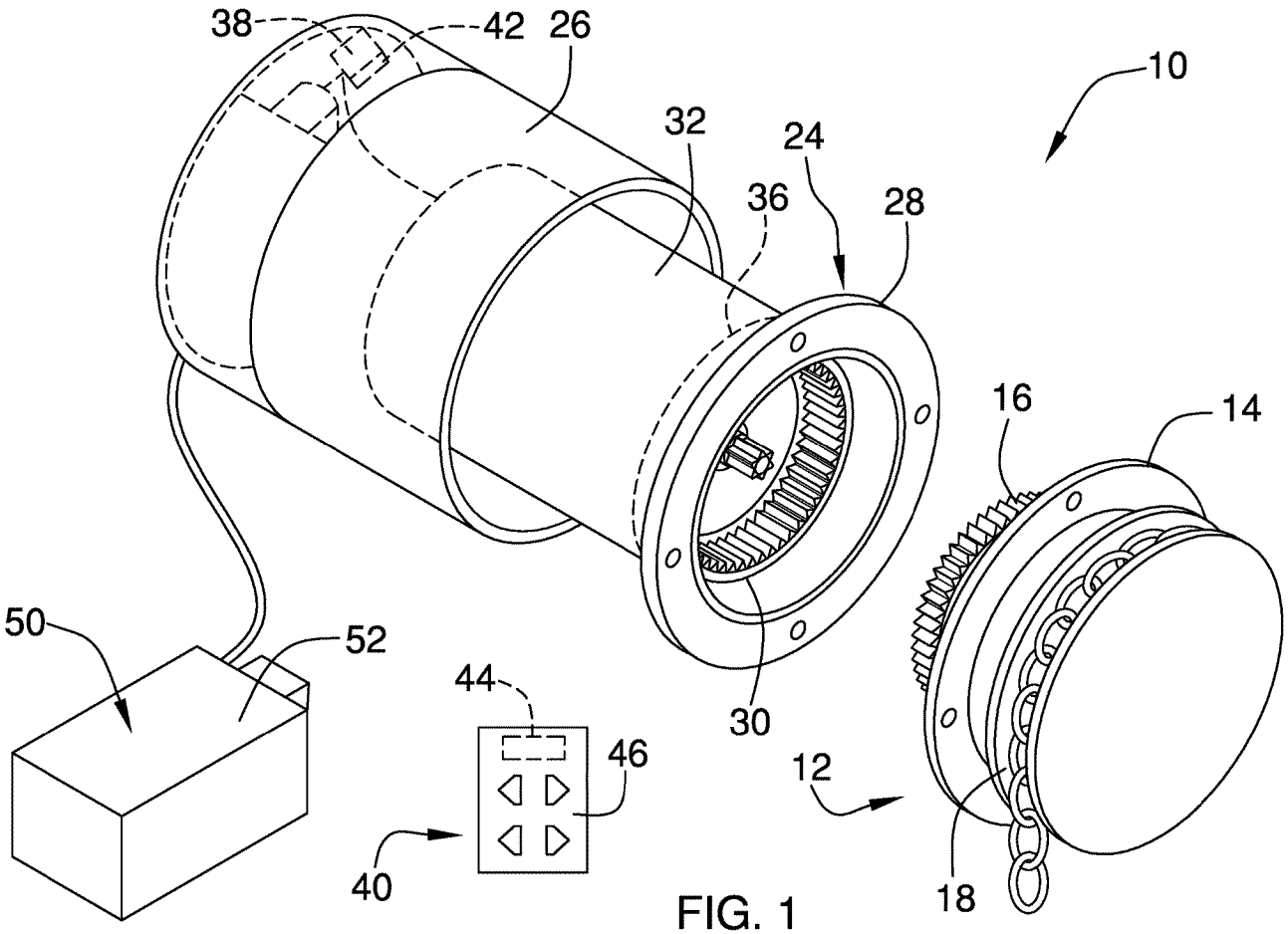
FIG. 1 is a partially exploded view of a manual to motorized chain lift conversion device according to an embodiment of the disclosure.
Figure 2:
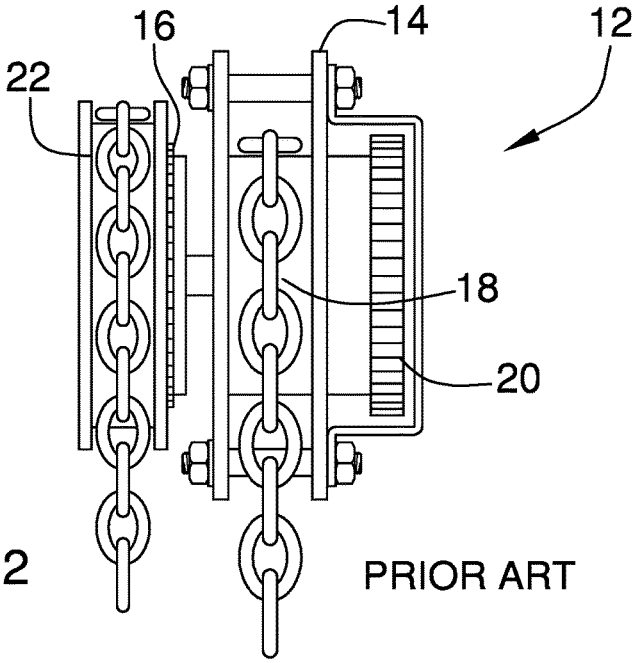
FIG. 2 PRIOR ART
FIG. 2 is a front view of a conventional manual chain lift.
Figure 3:
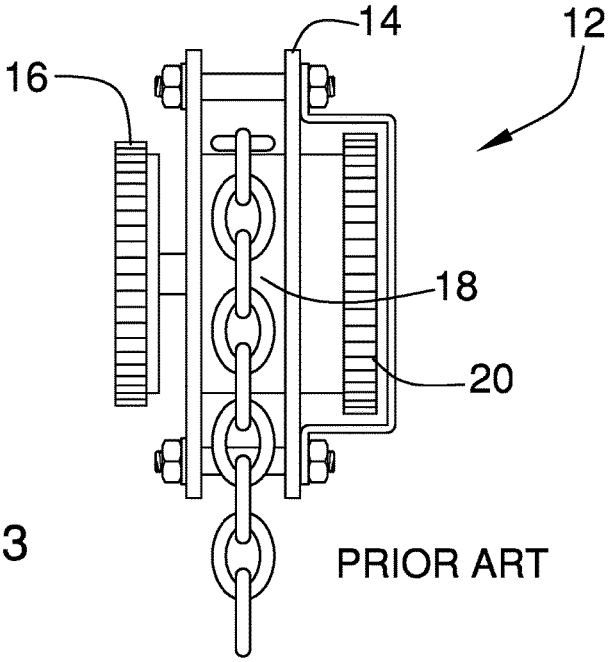
FIG. 3 PRIOR ART
FIG. 3 is a front view of a conventional manual chain lift with a chain wheel removed.
Figure 4:
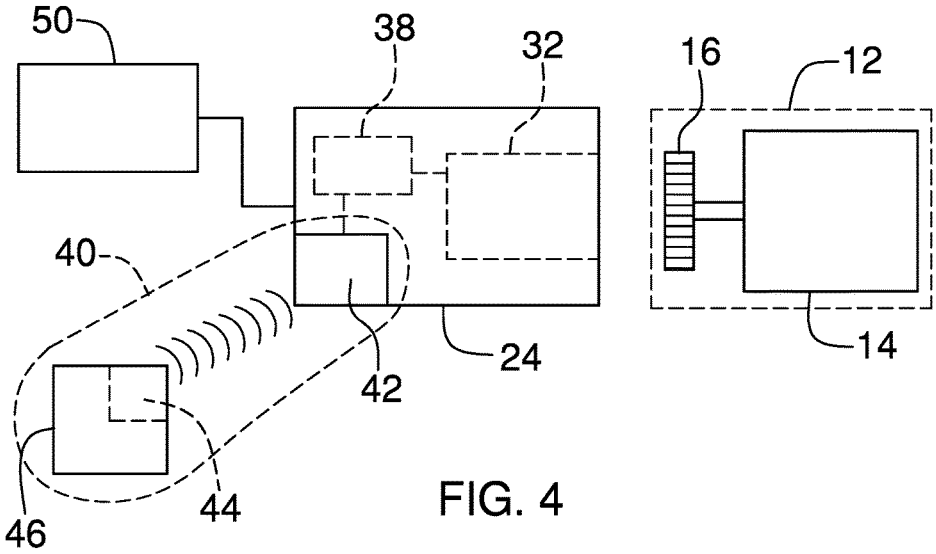
FIG. 4 is a schematic view of a wireless embodiment of the disclosure.
Figure 5:
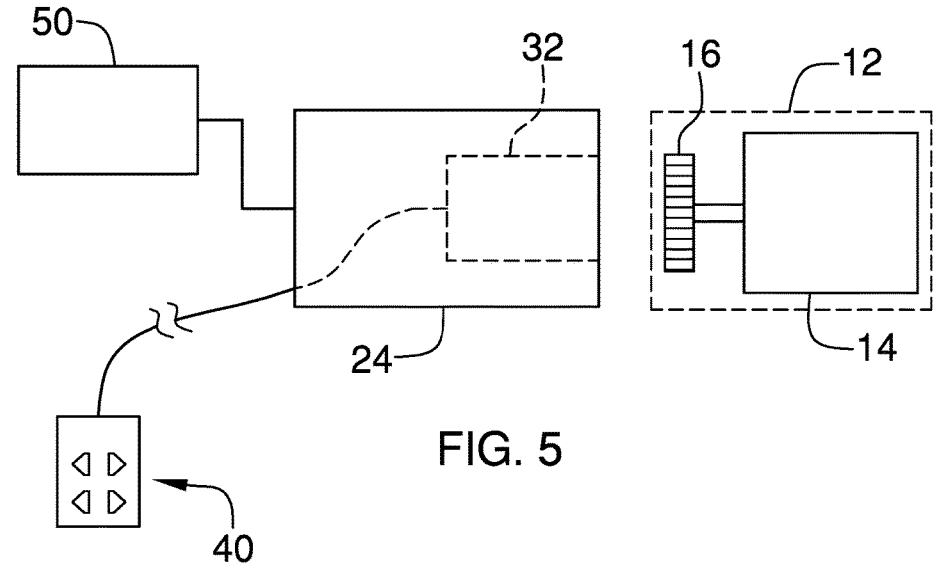
FIG. 5 is a schematic view of a hardwired embodiment of the disclosure.

With reference now to the drawings, and in particular to FIGS. 1 through 5 thereof, a new conversion device embodying the principles and concepts of an embodiment of the disclosure and generally designated by the reference numeral 10 will be described.

As best illustrated in FIGS. 1 through 5, the manual to motorized chain lift conversion system 10 generally comprises a chain lift 12 of substantially conventional design. The chain lift 12 has a lift frame 14, a drive shaft 16 coupled to the lift frame 14, a lift wheel 18 rotatably coupled to the lift frame 14, and a gear assembly 20 operationally coupling the drive shaft 16 to the lift wheel 18. The chain lift 12 would have a chain wheel 22 which is removable from the lift frame 14 for maintenance or repair. In a conventional manual configuration, the chain wheel 22 would be engaged by a hand chain formed into a loop and the chain wheel 22 would rotate the drive shaft 16 when the hand chain is pulled. The drive shaft 16 is exposed when the chain wheel is removed from the chain lift 12. An adapter 24 is coupled to the lift frame 14 replacing the chain wheel 22. The adapter 24 includes a guard 26 forming a housing extending from the lift frame 14. The adapter 24 includes an adapter plate 28 and a drive gear 30 exposed on the adapter plate 28. The adapter plate 28 is engaged to the lift frame 14 using conventional fasteners or connectors such as bolts or the like. A motor 32 is coupled to the adapter 24 such that the motor 32 is engages and rotates the drive shaft 16 of the chain lift 12. The guard 26 extends around the motor 32 such that the motor 32 is enclosed by the guard 26. The motor 32 is operable to rotate the drive shaft 16 in a selectable direction to selectively raise and lower a lifting chain 34 coupled to the lift wheel 18. The drive gear 30 is operationally coupled to the motor 32 to engage and couple the motor 32 to the drive shaft 16 when the adapter plate 28 is coupled to the lift frame 14. A clutch 36 of conventional design may operationally couple the motor 32 to the drive shaft 16. The clutch 36 disengages the motor 32 from rotating the drive shaft 16 beyond a threshold torque to prevent an excessive load being placed on the chain lift 12 during operation.

The motor 32 may be activated by a mechanical connection using a switch which is hardwired to the motor 32. The switch may be incorporated into the adapter 24 or attached to the adapter 24 by a cord. Alternatively, a processor 38 may be coupled to the adapter 24. The processor 38 is operationally coupled to the motor 32 wherein the processor 38 selectively activates and deactivates the motor 32. A motor control 40 is operationally coupled to the motor 32 such that the motor control 40 is configured for being manipulated to operate the motor 32. The motor control 40 is communicatively coupled to the processor 38. The motor control 40 may comprise a receiver 42 coupled to the adapter 24 and communicatively coupled to the processor 38. The motor control 40 further would include a transmitter 44 communicatively coupled to the receiver 42. The transmitter 44 is wirelessly coupled to the receiver 42 allowing for activation and deactivation of the motor 32 from a remote location. As such, the transmitter 44 may be coupled to a remote control 46 of conventional design having operational buttons to extend and retract the lifting chain 34 as desired. Control of rotational speed may also be provided through conventional operational buttons.

The motor 32 is powered by a battery 50. The battery 50 is coupled to the adapter 24. The battery 50 is electrically coupled to the motor 32 wherein the motor 32 is powered by the battery 50. The battery 50 is rechargeable and removably coupled to the adapter 24 wherein the battery 50 is replaceable. The battery 50 may be a conventional lithium ion type battery having an output range of between 10 and 20 volts such as are used in power tool sets. The battery 50 may also be of any particular voltage outside of the above range if used in a commercial tool set or line of products using an interchangeable battery, including as an example 60 volts. The battery 50 may also comprise a conventional modular casing 52 of the type used in power tool sets having interchangeable or common battery power sources. Thus, the battery 50 is configured for interchangeably powering the motor 32 and hand tools such as a drill, saw, sander, or the like.

In use, the chain wheel 22 is removed from the chain lift 12 to expose the drive shaft 16. The adapter 24 is connected to the lift frame 14 allowing the motor 32 to be used for rotating the drive shaft 16. Upon activation of the motor 32, the drive shaft 16 is rotated and the chain lift 12 operates in a conventional manner transferring rotation of the drive shaft 16 to the lift wheel 18 by way of the gear assembly 20. The system 10 provides for a light weight device with improved efficiency controllable from a distance to prevent worker fatigue and enhance worker safety. Power is provided by the battery 50 which is part of a modular system such that power for the motor 32 is readily available in a form commonly found in conventional garages, workshops, and the like.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A manual to motorized chain lift conversion system comprising:

a chain lift, said chain lift having a lift frame, a drive shaft coupled to said lift frame, a lift wheel rotatably coupled to said lift frame, and a gear assembly operationally coupling said drive shaft to said lift wheel, said chain lift having a chain wheel, said chain wheel being removable from said lift frame, said drive shaft being exposed when said chain wheel is removed from said chain lift;

an adapter, said adapter being configured for coupling to the lift frame;

a motor, said motor being coupled to said adapter such that said motor is configured to engage and rotate the drive shaft of the chain lift after the drive shaft is exposed;

a battery, said battery being coupled to said adapter, said batter being electrically coupled to said motor wherein said motor is powered by said battery;

a motor control, said motor control being operationally coupled to said motor such that said motor control is configured for being manipulated to operate said motor; and a processor coupled to said adapter, said processor being operationally coupled to said motor wherein said processor selectively activates and deactivates said motor, said motor control being communicatively coupled to said processor.

2. The system of claim 1, further comprising said motor being operable to rotate said drive shaft in a selectable direction to selectively raise and lower a lifting chain coupled to the lift wheel.

3. The system of claim 1, further comprising said battery having an output range of between 10 and 20 volts.

4. The system of claim 1, said motor control comprising:

a receiver coupled to said adapter, said receiver being communicatively coupled to said processor; and a transmitter communicatively coupled to the receiver.

5. The system of claim 4, further comprising said transmitter being wirelessly coupled to said receiver.

6. The system of claim 4, further comprising a remote control, said transmitter being coupled to said remote control.

7. The system of claim 1, further comprising said motor control being hardwired to said motor.

8. The system of claim 1, further comprising said battery being rechargeable.

9. The system of claim 1, further comprising said battery being removably coupled to said adapter wherein said battery is replaceable.

10. The system of claim 1, further comprising said adapter including a guard, said guard extending around said motor such that said motor is enclosed by said guard.

11. The system of claim 1, further comprising a clutch operationally coupling said motor to the drive shaft, said clutch disengaging said motor from rotating said drive shaft beyond a threshold torque.

12. The system of claim 1, further comprising said battery being a lithium ion battery.

13. The system of claim 1, further comprising said battery comprising a modular casing wherein said battery is configured for interchangeably powering said motor and hand tools.

14. The system of claim 1, further comprising said adapter including an adapter plate engaging said lift frame and a drive gear operationally coupled to said motor to engage and couple said motor to said drive shaft.

15. A manual to motorized chain lift conversion system comprising:

a chain lift, said chain lift having a lift frame, a drive shaft coupled to said lift frame, a lift wheel rotatably coupled to said lift frame, and a gear assembly operationally coupling said drive shaft to said lift wheel, said chain lift having a chain wheel, said chain wheel being removable from said lift frame, said drive shaft being exposed when said chain wheel is removed from said chain lift;

an adapter, said adapter being configured for coupling to the lift frame, said adapter including a guard, said adapter including an adapter plate and a drive gear, said adapter plate engaging said lift frame;

a motor, said motor being coupled to said adapter such that said motor is configured to engage and rotate the drive shaft of the chain lift after the drive shaft is exposed, said guard extending around said motor such that said motor is enclosed by said guard, said motor being operable to rotate said drive shaft in a selectable direction to selectively raise and lower a lifting chain coupled to the lift wheel, said drive gear being operationally coupled to said motor to engage and couple said motor to said drive shaft when said adapter plate is coupled to said lift frame;

a clutch operationally coupling said motor to the drive shaft, said clutch disengaging said motor from rotating said drive shaft beyond a threshold torque;

a processor coupled to said adapter, said processor being operationally coupled to said motor wherein said processor selectively activates and deactivates said motor, a motor control, said motor control being operationally coupled to said motor such that said motor control is configured for being manipulated to operate said motor, said motor control being communicatively coupled to said processor, said motor control comprising:

a receiver coupled to said adapter, said receiver being communicatively coupled to said processor; and a transmitter communicatively coupled to the receiver, said transmitter being wirelessly coupled to said receiver; and a remote control, said transmitter being coupled to said remote control;

a battery, said battery being coupled to said adapter, said batter being electrically coupled to said motor wherein said motor is powered by said battery, said battery being rechargeable, said battery being removably coupled to said adapter wherein said battery is replaceable, said battery being a lithium ion battery, said battery having an output range of between 10 and 20 volts, said battery comprising a modular casing wherein said battery is configured for interchangeably powering said motor and hand tools.

* * * * *